United States Patent [19]

Ashley, Jr. et al.

[11] Patent Number: 4,962,587

[45] Date of Patent: Oct. 16, 1990

[54] METHOD OF MAKING A WHEEL RIM

[75] Inventors: Walter L. Ashley, Jr., Detroit; Daniel F. Jansen, Saline; George Y. Meyer, Jr., Birmingham, all of Mich.

[73] Assignee: Kelsey-Hayes Company, Romulus, Mich.

[21] Appl. No.: 341,383

[22] Filed: Apr. 21, 1989

[51] Int. Cl.[5] ..... B21H 1/10

[52] U.S. Cl. ..... 29/894.35; 72/83

[58] Field of Search ..... 29/159.01, 159.1; 72/84, 85; 301/95-98

[56] References Cited

U.S. PATENT DOCUMENTS

| | | | |
|---|---|---|---|
| 3,255,518 | 6/1966 | Golata | 29/159.1 |
| 3,258,833 | 7/1966 | Schuttler | 29/159.1 |
| 3,846,886 | 11/1974 | Schroder et al. | 29/159.1 |
| 4,127,020 | 11/1978 | Bosch | 29/159.1 |
| 4,185,370 | 1/1980 | Evans | 29/159.1 |
| 4,528,734 | 7/1985 | Beyer | 29/159.01 |

*Primary Examiner*—P. W. Echols

*Attorney, Agent, or Firm*—MacMillan, Sobanski & Todd

[57] ABSTRACT

A method for producing vehicle wheel rims is disclosed. The method, as applied to a wheel rim preform having given axial width and having bead seat areas, as well and an inboard leg, entails a thinning and stretching operation applied to the well and inboard leg thereby producing a finished wheel rim having an axial width greater than the axial width of the preform and a weight of twenty to thirty percent less than similar prior art wheel rims.

7 Claims, 4 Drawing Sheets

METHOD OF MAKING A WHEEL RIM

BACKGROUND OF THE INVENTION

This invention relates to a method for manufacturing vehicle wheel rims. More specifically, the invention relates to a method wherein a roll formed wheel rim of a given width, and profile, is axially stretched to produce a finished wheel rim having an axial width greater than the original.

U.S. Pat. No. 4,185,370 discloses a prior art method of making roll formed wheel rims. The method comprises a plurality of forming steps sequentially applied to a hoop or band of material. The first forming operation comprises preforming the rim flange areas by flaring the lateral edges of the band or hoop. Once the band is flared, a well section, having a diameter less than the diameter of the band, is formed by a first roll forming operation. A second roll forming operation is then carried out to flatten the well section, further define the rim flanges and to provide safety hump areas. A final roll forming operation followed by an expander operation gives the rim its final dimensions. Wheel rims produced by this method have a relatively uniform material thickness throughout their axial cross-section equal to that required in the bead seat and flange areas. We have found that such a material thickness is not necessarily required in the well and inboard leg area of the rim.

SUMMARY OF THE INVENTION

The method of the present invention relates to an axial stretching, thinning and work hardening operation applied to the well and inboard leg material of a conventionally formed wheel rim thereby producing a finished wheel rim having an axial width greater than the original. The finished wheel rim may weigh twenty or thirty percent less than prior art wheel rims of similar width.

In accordance with the present invention a family of wheel rims having various axial widths may be produced from a single wheel rim preform. The wheel rim preform may be manufactured by the method taught in U.S. Pat. No. 4,185,370 or any other suitable technique. The well and inboard leg of the preform is then simultaneously stretched, thinned and work hardened between a mandrel and a forming roller, thereby axially widening the preform to produce a wheel rim of the desired width.

It is an object of the instant invention to provide a method for producing a vehicle wheel rim of a desired width from a wheel rim preform having a width less than the desired width.

It is another object of this invention to provide a method whereby a family of vehicle wheel rims having any plurality of axial widths may be produced from a single wheel rim preform.

It is a further object of this invention to provide a method for producing vehicle wheel rims, which weigh less than prior art wheel rims of similar size.

DETAILED DESCRIPTION OF THE INVENTION

Figure 1:
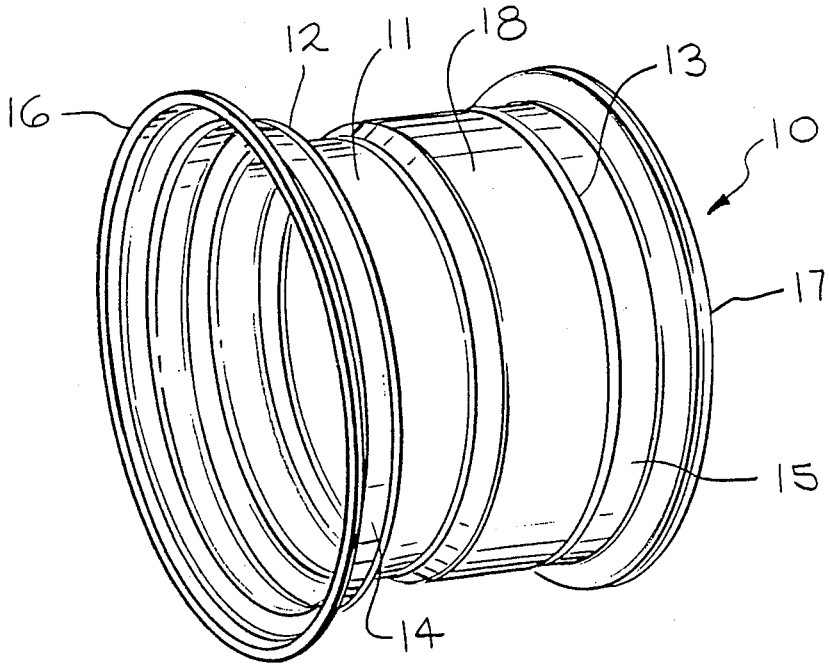
FIG. 1 is a perspective view of a typical vehicle wheel rim preform suitable for use in a method according to the present invention.

With reference to FIG. 1, a typical vehicle wheel rim preform is indicated generally at 10. The wheel rim preform 10 typically includes a well 11, an inboard leg 18, safety humps 12 and 13, bead seat areas 14 and 15, and radial flanges 16 and 17. The wheel rim preform 10 has a substantially uniform material thickness throughout, although there may be some small thickness variations arising from the forming process by which it was produced. U.S. Pat. No. 4,185,370, the disclosure of which is incorporated herein by reference, teaches a preferred method (hereafter, the prior art roll forming method) for producing a vehicle wheel rim which is suitable for use as a wheel rim preform in the present invention.

Figure 2:
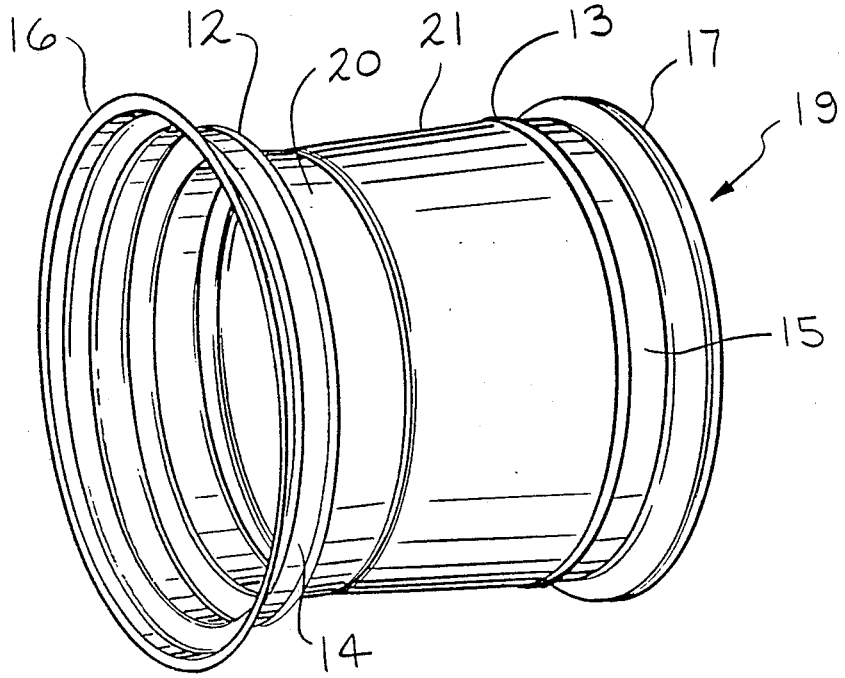
FIG. 2 is a perspective view of a vehicle wheel rim produced by a method according to the present invention.

With reference to FIG. 2, an axially stretched vehicle wheel rim is indicated generally at 19. The stretched wheel rim 19 has tire bead seat areas 14 and 15 and lateral flanges 16 and 17 corresponding with those in the vehicle wheel rim preform 10. The well 20 of stretched rim 19 has the same axial width as the well 11 of preform 10, however, the thickness of material within well 20 is less than that of well 11. The inboard leg 21 (FIG. 2) of the stretched wheel rim 19, however, has a greater axial width than the corresponding inboard leg 18 (FIG. 1) of wheel rim preform 10. The stretched wheel rim 19 (FIG. 2) can be produced, according to our invention, from the wheel rim preform 10 by a process in which the material constituting the well 11 and the inboard leg 18 is thinned radially, and stretched axially. The extent of thinning and stretching are limited in a particular application, not by our invention, but by the properties of the material from which the preform has been produced and the strength properties needed for a particular rim application.

According to our invention, stretched wheel rims in a variety of width dimensions may be produced from a single wheel rim preform. For example, a seventeen inch (43.2 cm) diameter wheel rim preform having an axial width of seven inches (17.8 cm) may be axially extended to a width of eleven inches (27.9 cm) or less.

During the stretching operation according to our invention, substantial weight and material cost savings are achieved. For example, a seventeen inch diameter by seven inch wheel rim preform has been produced from 5454 aluminum magnesium alloy by the prior art roll forming method. The resulting minimum thickness of the material in the well of the preform was measured at 0.235 inches (6.0 mm) and the preform weighed 10.91 pounds (4.95 Kg). The preform was then stretched to a width of nine and one half inches. The thickness of the material in the well and the adjacent inboard leg section was reduced to approximately 0.126 inches (3.2 mm).

By comparison, a prior art seventeen inch diameter wheel rim having an axial width of nine and one half inches produced according to the prior art roll forming method from the same 5454 aluminum magnesium alloy weighed 13.55 pounds (6.15 Kg) and had a minimum thickness of 0.235 inches (6.0 mm). Thus, a nine and one half inch wheel rim produced according to the present invention exhibits a material savings and weight reduction of nineteen percent over the prior art.

An eleven inch aluminum wheel rim produced by the prior art method weighs 15.08 pounds (6.84 Kg). For this wheel size the present invention provides material savings and a weight reduction of twenty eight percent over the prior art.

With reference to FIG. 3*a*, metal spinning apparatus suitable for use in producing a stretched wheel rim, according to the present invention, is illustrated. A mandrel 25 is mounted on a spindle 26 for rotation thereabout, by fasteners 27. Opposite mandrel 25 is an end plate 28 mounted on a spindle 29 for rotation thereabout, by fasteners 30. The spindles 26 and 29 have a common axis of rotation R. Spindle 26 is driven and spindle 29 is part of the tailstock assembly (not shown). However, it is believed that the invention may best be carried out on apparatus in which a mandrel corresponding to mandrel 25 is mounted on part of the tailstock assembly and a plate corresponding with the end plate 28 is driven.

Figure 3:
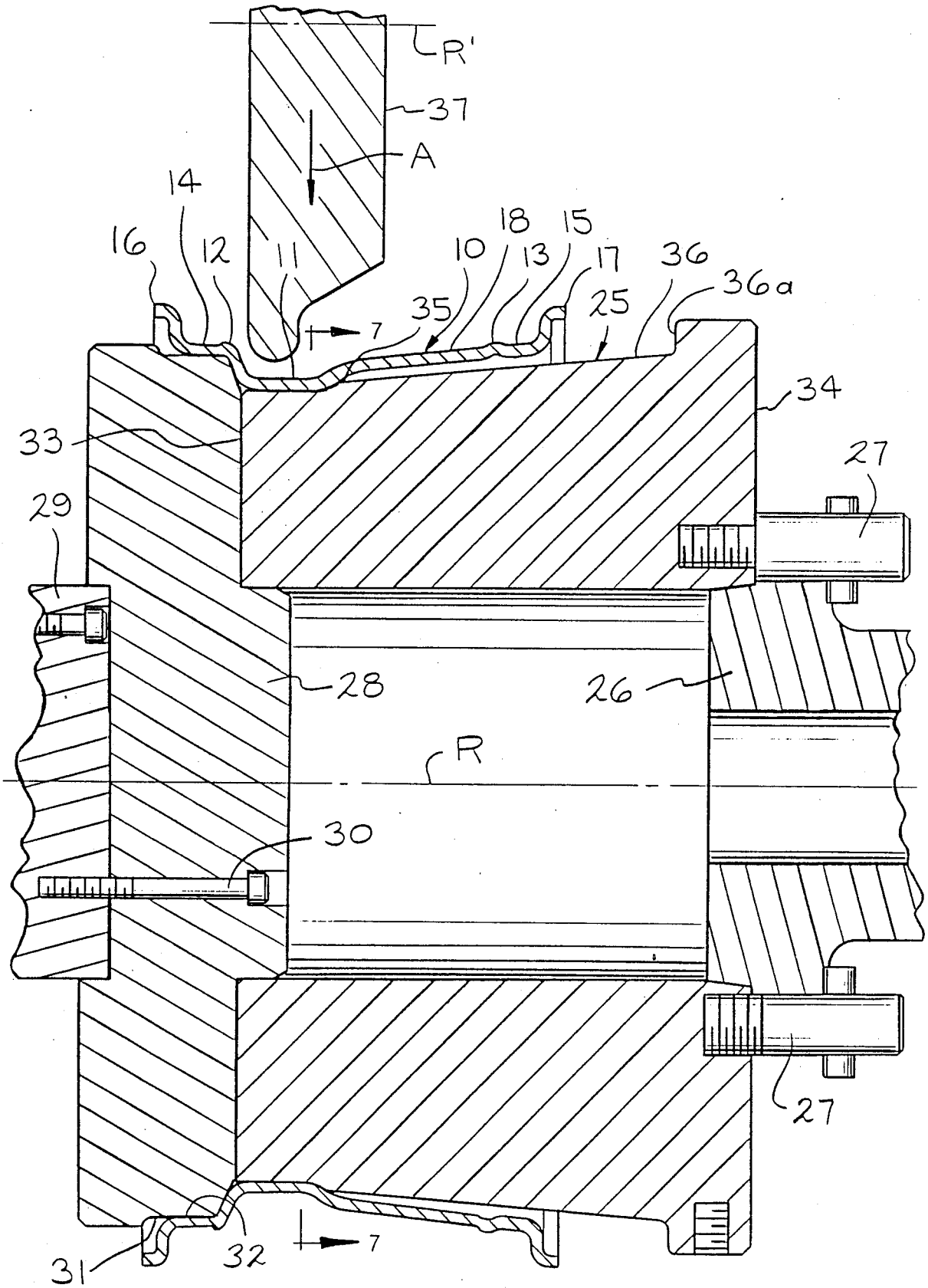
FIG. 3 is a cross-sectional view of a wheel rim preform mounted on metal spinning equipment which can be used in carrying out a wheel rim forming operation according to the present invention.

A vehicle wheel rim preform 10 is illustrated in FIG. 3, mounted on the end plate 28 and the mandrel 25 for rotation therewith about the common axis of rotation R. The end plate 28 has a surface 31 which is sized to provide a friction fit with the interior surface 32 of preform 10, opposite the bead seat area 14. Similarly, the mandrel 25 is sized, adjacent a first end 33 thereof, to fit snugly inside the preform 10, internally engaging well 11 as shown. Moving from left to right along the mandrel 25, from the first end 33 to a second end 34, the exterior diameter of the mandrel 25 is constant out to a well shoulder 35, where there is a relatively sudden diameter increase. Moving towards the second end 34 of the mandrel 25 from the well shoulder 35, the exterior diameter steadily and gradually increases, forming a concical surface of revolution 36 which, in turn, preferably forms an angle of approximately five degrees (5°) with the axis of rotation R and, as shown in FIG. 3, terminates in a radially outwardly extending bead seat stop surface 36*a*″.

A forming roller 37 is poised for engagement with a portion of the wheel rim preform 10, which will occur when the forming roller 37 is advanced in the direction of arrow A. The roller 37 is supported on mounting means (not shown) for rotation about an axis of rotation R′ which is parallel to the axis of rotation R of the mandrel 25 and the end plate 28. The position of the mounting means (not shown) for the roller 37, relative to the mandrel 25, is controlled by conventional, two-axis, indexing means (not illustrated).

Figure 4:
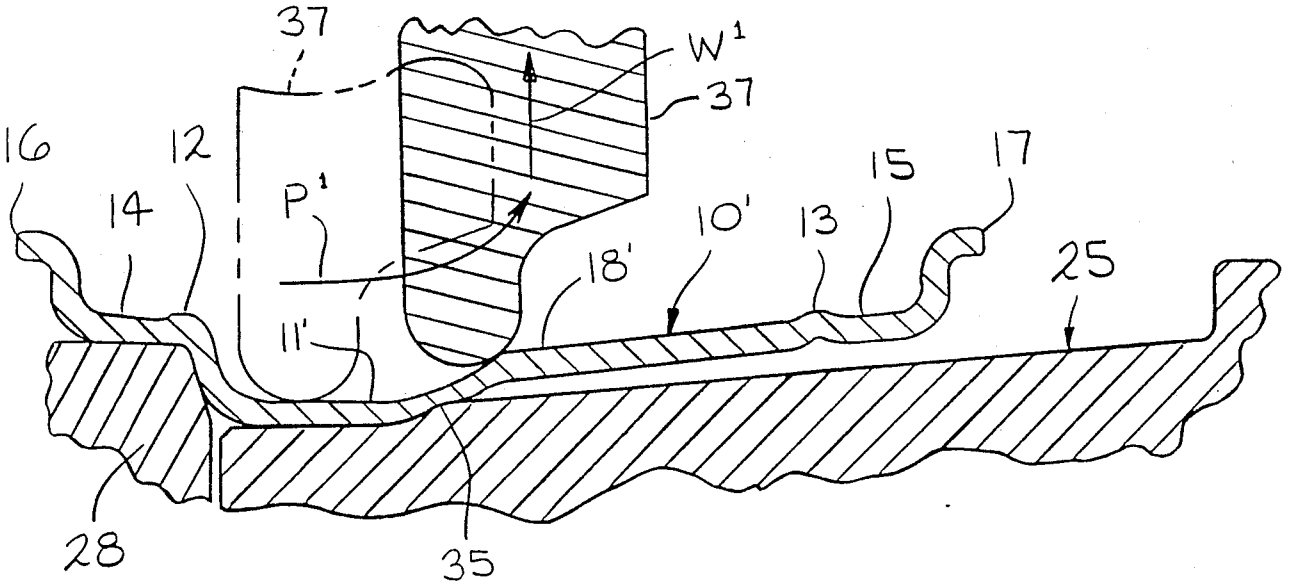
FIG. 4 is a cross-sectional view of a portion of the apparatus shown in FIG. 3, illustrating a first metal spinning operation in a method according to the present invention.
Figure 5:
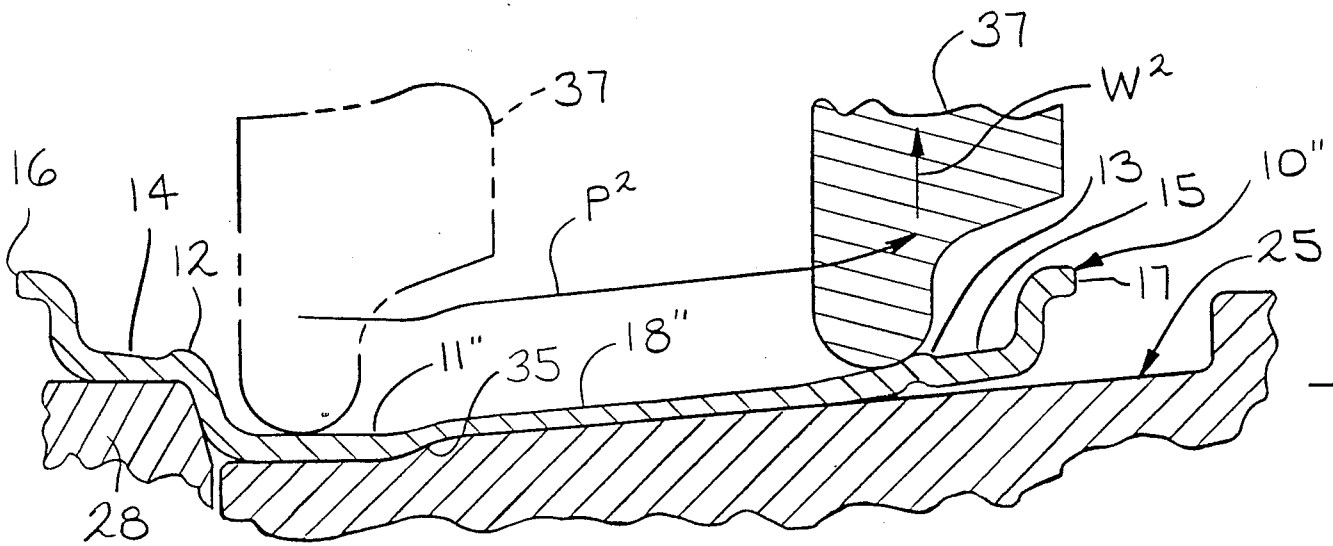
FIG. 5 is a cross-sectional view similar to that shown in FIG. 4, but illustrating a second metal spinning operation in a method according to the present invention.
Figure 6:
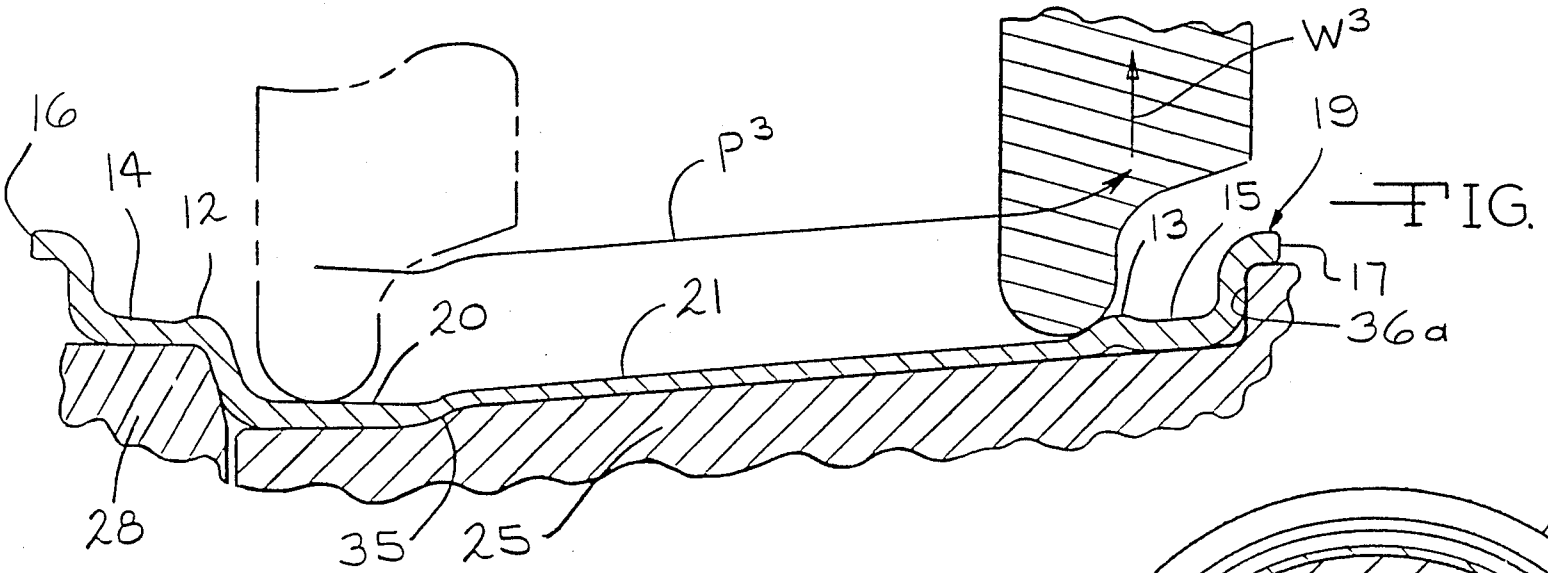
FIG. 6 is a cross-sectional view similar to that shown in FIG. 4, but illustrating a third metal spinning operation in a method according to the present invention.

Referring now to FIGS. 4 through 6, there is illustrated an indexing sequence for the roller 37, in a method for producing a vehicle wheel rim from a wheel rim preform 10 (FIG. 3). The roller 37 is advanced toward the mandrel 25, along the path of arrow A (FIG. 3) until the roller 37 engages well 11 of preform 10. The roller 37 makes a first pass generally along a metal spinning path depicted by an arrow, $P^1$ (FIG. 4). When the roller 37 reaches the end of the path $P^1$, near the well shoulder 35, it is withdrawn from the mandrel 25, along a path generally denoted by an arrow $W^1$. In the first pass, the material of the well 11 and a portion of the inboard leg 18, is thinned and the overall width of the preform 10 is increased to produce a well 11′ and an inboard leg 18′ as shown in FIG. 4.

A second pass of the forming roller 37, depicted in FIG. 5, is made generally along a path depicted by an arrow $P^2$. In making the second pass, the roller 37 again thins well 11′ (FIG. 4) and performs the first thinning-stretching of the inboard leg 18′, thereby further widening preform 10′ and producing well 11″ and inboard leg 18″ in preform 10″.

A third and final pass of the forming roller 37, illustrated in FIG. 6, is made along a path generally depicted by an arrow $P^3$. During the final pass, well 11″ (FIG. 5) and inboard leg 18″ are further worked to produce the finished well 20 (FIG. 6) and inboard leg 21 resulting in the finished vehicle wheel rim 19 wherein, as shown in FIG. 6, the tire bead seat 17 engages the bead seat stop surface 36*a*. During the spin forming operation the material of the well and inboard leg is not only thinned and stretched but is also work hardened thereby increasing the fatigue strength in these areas. Additional cold working may be performed while the stretched wheel remains upon the mandrel if desired.

Figure 7:
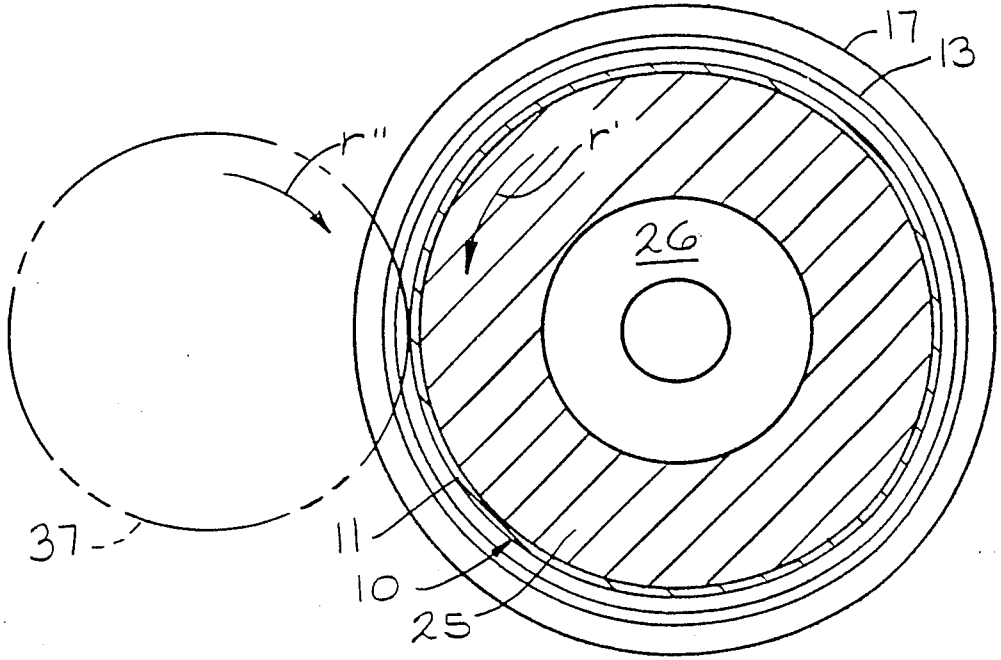
FIG. 7 is a cross-sectional view taken along the line 7—7 of FIG. 3.

With reference to FIG. 7, the forming roller 37 is illustrated in phantom lines in a position where it is contacting the wheel rim preform 10. The roller 37 is not driven except by the torque applied to it by the wheel rim preform 10, as it rotates in the direction indicated by arrow r′ causing the roller 37 to rotate in the opposite direction indicated by arrow r″. It may be desirable, in some instances, to drive roller 37 independently of the rotating wheel rim preform. The size and profile of the forming roller may be varied from that illustrated in FIG. 7.

The process steps described above with reference to FIGS. 4 through 6 have been utilized to produce seventeen inch diameter aluminum wheel rims having either a finished width of nine and one half inches and eleven inches from a seventeen inch diameter by seven inch wide wheel rim preform. The preforms were made from sheets of 5454 aluminum alloy, by the prior art roll forming method described in U.S. Pat. No. 4,185,370. The preforms were mounted on a mandrel and an end plate and rotated at the rate of six hundred revolutions per minute. The forming roller was indexed to make the three passes, corresponding generally with the passes $P^1$, $P^2$ and $P^3$, described above, to produce the finished wheel rims.

It should be readily apparent that the method herein taught produces a unique vehicle wheel rim in which the material constituting the outer flanges and teh bead seat areas has a given tichness, desinged to withstand the stresses these portions of the whell rim encounter in service, while the thickness of the material between the bead seats is substantially less. Seventeen inch diameter by nine and one half inch wide wheel rims produced from seventeen inch diameter by seven inch wide preforms in accodance with the present method, have undergone and passed laboratory fatigue testing. This testing proved that such wheel rims have the necessary strength and fatigue parameters required in vehicular applications. Similarly, seventeen inch diameter by eleven inch wide wheel rims produced from seven inch wide preforms in accordance with the present method, have undergone and passed laboratory fatigue testing. This testing also indicates that such wheel rims have the strength and fatigue characteristics required in vehicular applications.

In practicing the instant invention, the amount by which a wheel rim preform is widened will depend upon numerous factors including the ductility of the material of which the preform is composed, the width of the preform, the width desired for a finished wheel rim, and the operational parameters required of the finished wheel rim. In a qualitative sense, the present invention contemplates widening a vehicle wheel preform a substantial amount. In a quantitative sense, a substantial amount may translate into a ten percent increase in width, a thirty percent increase in width, or something else.

It will be readily appreciated, by those skilled in the art of metal forming and shaping, that indexing sequences for a forming roller in spinning equipment, other than the three pass sequence disclosed above, can be employed to effect a substantial widening of a vehicle wheel preform according to the present invention. For example, in some instances, a single pass may be employed to substantially widen a vehicle wheel rim preform in accordance with the invention.

The foregoing description sets forth the best mode for practicing the instant invention and is intended to enable those skilled in the art to practice it. Modifications and alterations may occur to those skilled in the art but fall, nonetheless, within the spirit and scope of the appended claims.

What is claimed is:

1. A method of producing a wheel rim comprising the steps of:

(a) providing a preformed wheel rim having a first predetermined axial width and including a tire bead seat formed at one axial end, an opposite axial end axially spaced from the tire bead seat, and a generally axially extending intermediate leg located between the opposite axial end and the tire bead seat;

(b) providing a mandrel having a generally axially extending forming surface and a bead seat stop surface extending generally radially outwardly from one end thereof;

(c) inserting the mandrel into the rim such that the intermediate leg of the rim surrounds the forming surface of the mandrel and the bead seat stop surface is axially spaced from the bead seat by a predetermined amount;

(d) securing the opposite axial end of the rim relative to the mandrel to prevent any relative axial movement therebetween; and (e) subsequent to step (d), thinning only the intermediate leg of the rim to axially stretch the rim until the bead seat engages the bead seat stop surface provided on the mandrel to produce a wheel rim having a second predetermined width greater than said first predetermined width by the predetermined amount.

2. The method according to claim 1 wherein step (e) is accomplished by a metal spinning operation.

3. The method according to claim 1 wherein, subsequent to step (d) and prior to step (e), the intermediate leg is spaced radially outwardly from the forming surface of the mandrel and wherein, during step (e), the intermediate leg is urged into engagement with the forming surface.

4. The method according to claim 1 wherein step (a) includes the step of providing the preformed wheel rim with oppositely facing and generally radially extending wall surfaces at the opposite axial end and step (b) includes the step of providing the mandrel with a wall engaging surface extending generally radially inwardly from the opposite end of the forming surface, and wherein step (d) includes the step of maintaining one of the wall surfaces of the rim in secure engagement with the wall engaging surface of the mandrel.

5. The method according to claim 4 wherein step (d) further includes the step of providing an end plate, and moving the end plate into engagement with the other one of the wall surfaces of the rim.

6. The method according to claim 1 wherein step (a) includes the step of providing the preformed wheel rim with a second tire bead seat at the opposite axial end and a radially inwardly extending well formed between the second tire bead seat and the intermediate leg.

7. The method according to claim 1 wherein step (a) includes the step of providing the preformed wheel rim with a radially outwardly extending safety hump axially spaced from the tire bead seat and wherein the one end of the intermediate leg terminates at the safety hump.

* * * * *